US006517390B2

(12) United States Patent
Kim

(10) Patent No.: US 6,517,390 B2
(45) Date of Patent: Feb. 11, 2003

(54) CONNECTING TERMINAL FOR STORAGE BATTERY

(76) Inventor: Hwan-Chang Kim, 38/5, 495-11, Wueolpi-don, Ansan-shi, Kyunggi-do (KR), 428-855

( * ) Notice: Subject to any disclaimer, the term of this patent is extended or adjusted under 35 U.S.C. 154(b) by 0 days.

(21) Appl. No.: 10/007,313

(22) Filed: Dec. 10, 2001

(65) Prior Publication Data

US 2002/0094728 A1 Jul. 18, 2002

(30) Foreign Application Priority Data

Jan. 12, 2001 (KR) ..... 2001-0000797

(51) Int. Cl.[7] ..... H01R 4/28

(52) U.S. Cl. ..... 439/754; 439/763; 439/765; 439/883

(58) Field of Search ..... 439/754, 762, 439/763, 764, 765, 883; 429/178, 121, 65

(56) References Cited

U.S. PATENT DOCUMENTS 5,302,143 A * 4/1994 Inoue et al. ..... 439/762
5,486,434 A * 1/1996 Aoyama ..... 439/766
5,597,331 A * 1/1997 Gable et al. ..... 439/754
5,645,448 A * 7/1997 Hill ..... 439/763

* cited by examiner

*Primary Examiner*—P. Austin Bradley
*Assistant Examiner*—Briggitte Hammond
(74) *Attorney, Agent, or Firm*—Lowe Hauptman Gilman & Berner, LLP

(57) ABSTRACT

The present invention relates to a connecting terminal for an automobile storage battery, or more particularly, to a connecting terminal for a storage battery, wherein a connecting terminal part 1 connecting to a post-terminal 3 for a storage battery, and connection terminals (7*a*, 7*b*, 7*c*, 7*d*, 7*e*) for fixing a wire connector (C) are made attachable or detachable by means of bolts (9*a*, 9*b*, 9*c*, 9*d*) and nuts (10*a*, 10*b*, 10*c*, 10*d*) in conjunction with washers (8*a*, 8*b*, 8*c*, 8*d*); and the insertion holes (4, 4') of the connecting terminal part 1 are tightened with appropriate tightening force by means of a tightening bolt 5 having a screw thread only at the portion at its lower end, which incorporates into a unit a rubber cap in the shape of a band, which covers the upper and lower portions of the connecting terminal part 1 connected to said post-terminal, and which has protrusions 11" in the shape of a ring, respectively, around the rim of the bottom side of the piercing hole 11' of the rubber cap 11, which is bored onto the portion corresponding to the insertion hole 4' of the lower end of the connecting terminal part 1.

16 Claims, 4 Drawing Sheets

CONNECTING TERMINAL FOR STORAGE BATTERY

TECHNICAL FIELD

The present invention relates to a connecting terminal for an automobile storage battery, or more particularly, to a connecting terminal for an automobile storage battery, which incorporates a rubber cap in the shape of a band into a unit, which covers the upper and lower portions of a connecting terminal part joined to a post-terminal, wherein said connecting terminal for an automobile storage battery allows detachment of the connecting terminal part connecting to the post-terminal for a storage battery, and connection terminals for fixing a wire connector.

BACKGROUND OF THE INVENTION

There are a variety of types of connecting terminals, which are designed to connect to post-terminals of automobile storage batteries. Most of them have an integrated into a unit connection terminals for fixing a wire connector, and a connecting terminal part connecting to a post-terminal of a storage battery. As such, there is an accompanying inconvenience of using separate connection terminals, formed into one or two units, if deemed necessary.

Moreover, depending on its usage, the connection terminal of said connecting terminal could be formed into two or more units. However, it was somewhat problematic since the conventional connecting terminal could not be used as a connecting terminal requiring two or more connection terminals.

Moreover, an ordinary storage battery continually discharges sulfuric gas generated from a storage battery through the rim of the lower end of a post-terminal of a storage battery during its use. After some time during its use, it tends to corrode said post-terminal exposed to sulfuric gas and also the connecting terminal part joined thereto. This type of corrosion is problematic since it tends to deteriorate the performance of said storage battery.

SUMMARY OF THE INVENTION

The present invention was devised to solve the aforementioned problems of the conventional connecting terminal for a storage battery. In this regard, the objective of the present invention is to provide a connecting terminal, which allows, depending on the need, separate connections of various numbers of connection terminals to one connecting terminal part by way of separating a connecting terminal part and connection terminals, wherein a rubber cap in the shape of a band covers the connecting terminal connected to said post-terminal to prevent corrosion by sulfuric gas.

In order to achieve the aforementioned objectives, the present invention incorporates a rubber cap in the shape of a band into a unit with a connecting terminal, which covers the upper and lower portions of the connecting terminal part. In this regard, the present invention allows attachment or detachment of the connecting terminal part and connection terminals from one another via bolts, wherein said connection terminals, positioned at one side of the upper portion therein, are connected to said connecting terminal part.

DETAILED DESCRIPTION OF THE PREFERRED EMBODIMENTS

Figure 1:
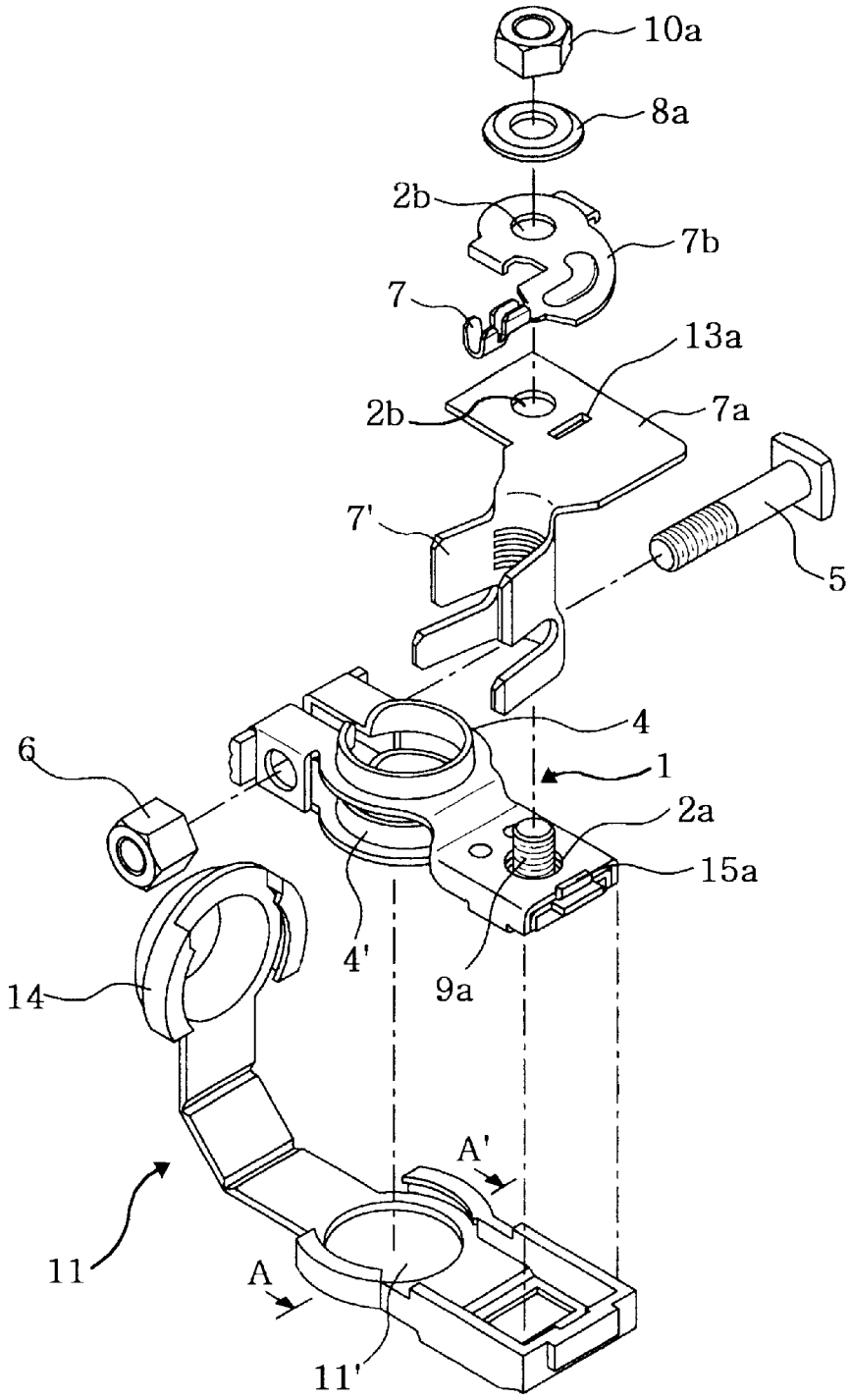
FIG. 1 is an exploded perspective view of the connecting terminal for a storage battery according to the first embodiment of the present invention.
Figure 2:
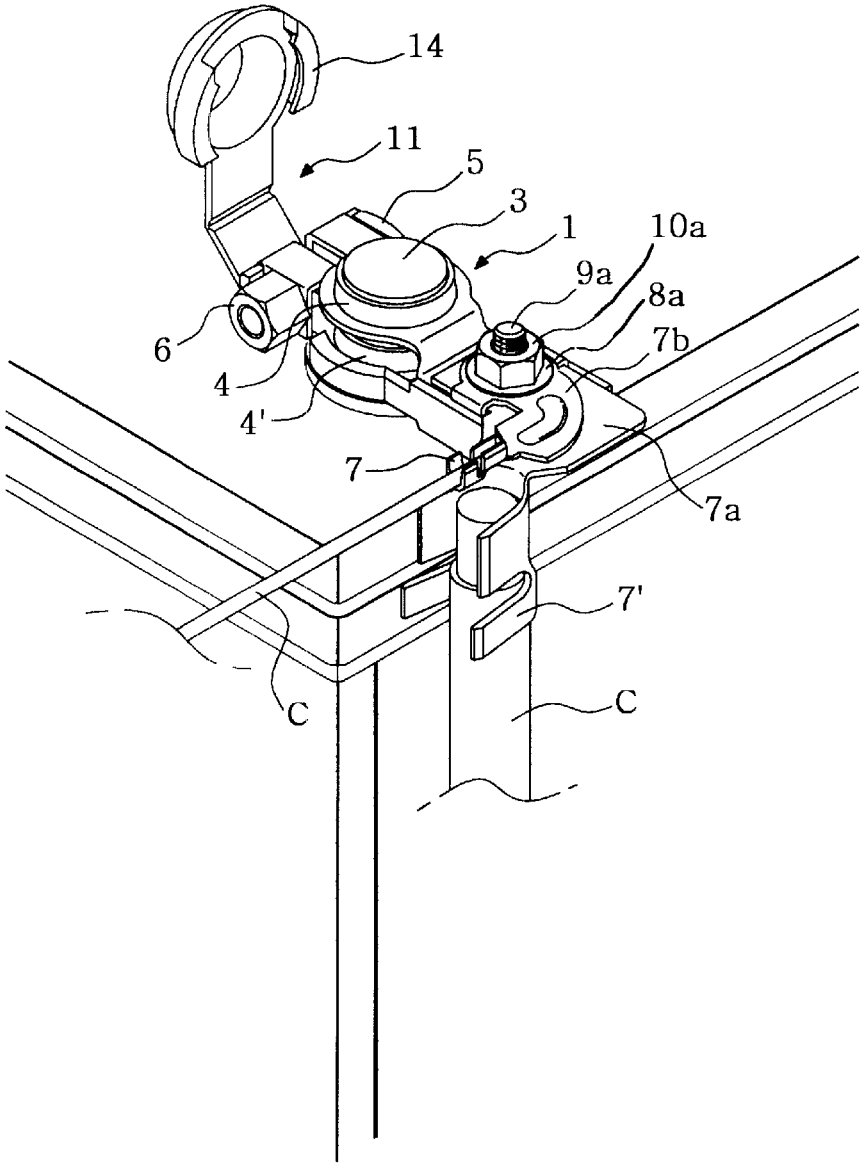
FIG. 2 is a drawing of FIG. 1 as assembled.

The construction of the connecting terminal for a storage battery according to the present invention is described in further detail With references to the attached drawings as below:

FIG. 1 is an exploded perspective view of the connecting terminal for a storage battery according to the first embodiment of the present invention. FIG. 2 is a drawing of FIG. 1 as assembled. As illustrated, a bolt clamping hole (2*a*) is bored into the upper end on one side of the connecting terminal part 1. To the other side, insertion holes (4, 4'), into which a post-terminal 3 is inserted, are formed in such a way to face each other while having an opening at one side. To the opened portion of said insertion holes (4, 4'), a tightening bolt 5 and a fixation nut 6 are joined horizontally into the insertion holes (4, 4'). In this manner, the diameter of the insertion holes (4, 4') can be adjusted by tightening of said tightening bolt 5, and the post-terminal 3 can be firmly tightened thereby.

Meanwhile, the tightening bolt 5 is designed in such a way that a screw thread is formed only at the portion of its lower end. Thus, the tightening bolt 5 is tightened only up to the portion having formation of said screw thread. In this manner, the damage to the connecting terminal part 1, which can occur by continual over-tightening of the tightening bolt 5, can be prevented.

In continuation, a bolt clamp hole (2*b*) is respectively bored to one side of connection terminals (7*a*, 7*b*) connected to one side of the above connecting terminal part 1. It is aligned with the bored bolt clamp hole (2*a*) at the one side of the upper end of said connecting terminal part 1. Then, the connection terminals (7*a*, 7*b*) of the two types, respectively overlapping over the connecting terminal part 1, are fixed with a bolt (9*a*) and a nut (10*a*), interposed by a washer (8*a*), through said bolt clamping holes (2*a*. 2*b*). To the other side, the connection sections (7, 7' ), which connect the connector (C), are respectively formed in place. Meanwhile, one of the connection sections 7, which is of different type from the other, should be bent vertically thereon.

Meanwhile, a portion (15*a*) of the end on one side of the connecting terminal part 1 is bent upward for insertion into the rectangular hole (13*a*) bored onto one side of the connection terminal (7*a*). In this manner, it prevents loosening of said connecting terminal part 1 and the connection terminal (7*a*) by way of vibration of automobile, etc.

Moreover, in Embodiment 1 of the present invention, a rubber cap in the shape of a band over the connecting terminal part 1 could be used for preventing its exposure to sulfuric gas.

Figure 3:
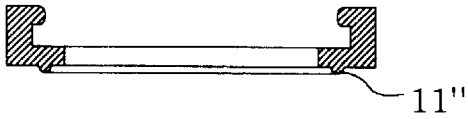
FIG. 3 is a cross-sectional view of FIG. 1 along line A–A'.

In other words, a rubber cap 11 in the shape of a band could be connected thereto, which covers over from the lower end of one side of the connecting terminal part 1 to the upper end of the other side of the insertion hole 4. Then, piercing hole 11' corresponding to said insertion hole 4' should be bored at the portion thereof corresponding to the insertion hole 4' of the lower end of the other side of said connecting terminal part 1. As illustrated in FIG. 3, protrusions 11" in the shape of a ring, respectively, should be formed around the rim of the bottom side of said piercing hole 11'. The portion which is connected to the insertion hole 4 of the upper end of the other side of said connecting terminal part 1 should be formed into a cap which completely covers and seals said insertion hole 4. In the overall picture, a rubber cap 11 in the shape of a band is formed thereon.

Meanwhile, the protrusions 11" in the respective shape of a ring and the cap 14 suppress the discharge of sulfuric gas generated from the storage battery through a post-terminal 3. Moreover, they have the effect of preventing corrosion of the connecting terminal part 1, which may be caused by its partial exposure to sulfuric gas.

Figure 4:
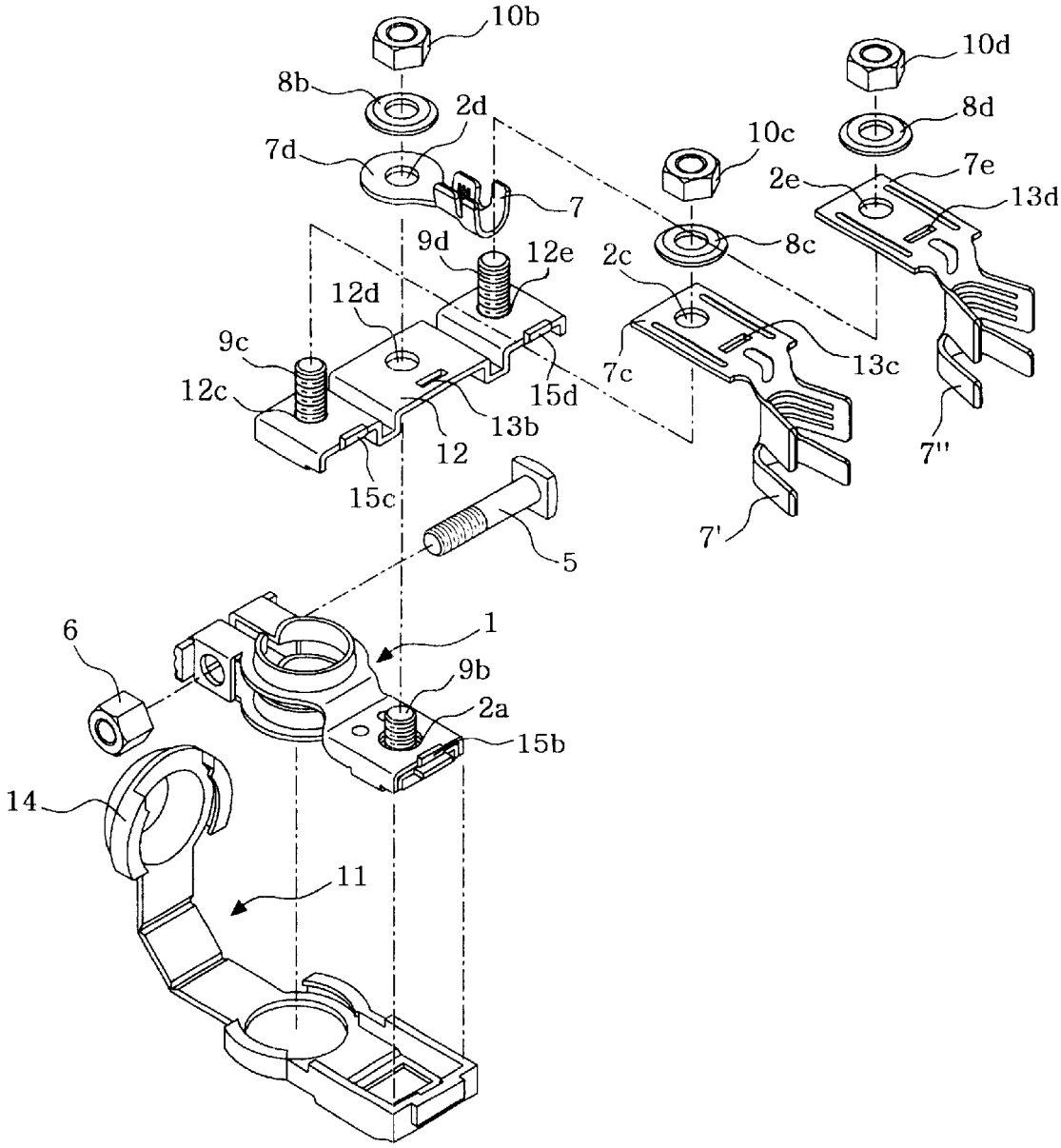
FIG. 4 is an exploded perspective view of the connecting terminal for a storage battery according to the second embodiment of the present invention.
Figure 5:
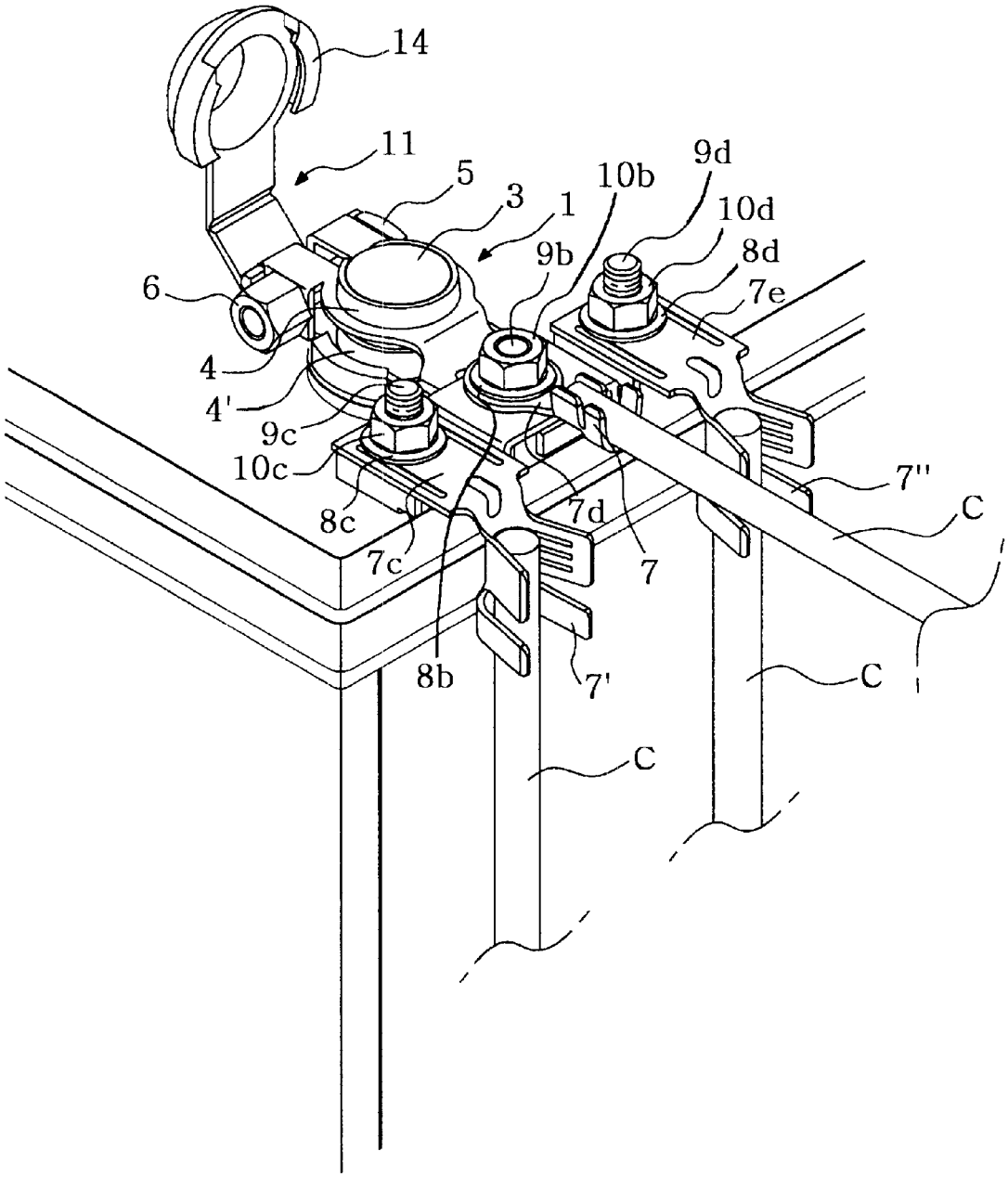
FIG. 5 is a drawing of FIG. 2 as assembled.

FIG. 4 and FIG. 5 respectively represent the connecting terminal for a storage battery according to the second embodiment of the present invention. FIG. 4 is an exploded perspective view of the dissembled connecting terminal for a storage battery. FIG. 5 is a drawing of FIG. 4 as assembled the second embodiment relates to a connecting terminal with a multiple units of connection terminals connected to the connecting terminal part of the first embodiment.

As illustrated, the bolt clamping hole (2*d*) bored onto the middle connection terminal (7*d*) among three connection terminals (7*c*, 7*d*, 7*e*), aligned in a queue, and the bolt clamp hole (2*a*) of the connecting terminal part 1 are interposed by a connecting member 12 in the shape a long plate. Then, the bolt clamp hole (12*d*) bored onto the middle of said connecting member 12 is aligned with said bolt clamping hole (2*d*) and with said bolt clamp hole (2*a*). The connecting terminal part 1, the connecting member 12, and the connection terminal (7*d*) are simultaneously fixed in place with a washer (8*b*) in conjunction with a bolt (9*b*) and a nut (10*b*). The bolt clamp holes (2*c*, 2*e*) bored into the middle of the two sides of the connection terminals (7*c*, 7*e*), and the bolt clamp holes (12*c*, 12*e*) bored into the two lateral sides of the connecting member 12 are aligned thereto, and then the connection terminals (7*c*, 7*e*) and the connecting member 12 are mutually fixed in place with washers (8*c*, 8*d*) in conjunction with bolts (9*c*, 9*d*) and nuts (10*c*, 10*d*).

Meanwhile, the end portion (15*b*) of one side of the connecting terminal part 1 is bent upward and inserted into the rectangular hole (13*b*) bored into one side of the connecting member 12. The respective end portions (15*c*, 15*d*) of the two lateral sides of the connecting member 12 are bent upward and inserted into the rectangular holes (13*c*, 13*d*) respectively bored into the middle of the two lateral sides of the connection terminals (7*c*, 7*e*). In this manner, it prevents loosening of the connecting member 12 and the connection terminals (7*c*, 7*d*, 7*e*) by vibration of automobile, etc. There, the connection terminals (7*c*, 7*d*, 7*e*) are limited to three units. However, three or more units of connection terminals could be used therein. As in the first embodiment, a rubber cap 11 in the form of a band is utilized in the same manner. To the other side of said connection terminals (7*c*, 7*d*, 7*e*), there are connection sections (7, 7', 7"), which connect the connector (C). The connection sections (7', 7") of the two connection terminals (7*c*, 7*d*) among three connection terminals, which are of different types than that of the connection terminal (7*d*), are bent vertically therein.

According to the connecting terminal for a storage battery of the present invention, constructed as such with the aforementioned objectives, it allows usage of various types of connection terminals by separately connecting them to one connecting terminal part, depending on its usage, since the present invention allows detachment of the connecting terminal part and connection terminals. Moreover, the present invention allows prevention of corrosion of the post-terminal and the connecting terminal part connected thereto by their exposure to sulfuric gas due to its use of a rubber cap in the shape of a band. It also provides safe connection of the connecting terminal part to said post-terminal by way of a tightening bolt which can adjust tightening force to the level which is appropriate to the connecting terminal part therein.

What is claimed is:

1. A connecting terminal for a storage battery, which comprises a connecting terminal part which tightens insertion holes, to which a post-terminal is inserted, by a tightening bolt; and selectively attachable connection terminals connected thereto, which connects a wire connector;

wherein said connection terminals comprise first and second types of connection terminals, which are overlapping thereto, one side of which is connected to the connecting terminal part, respectively, and to another side of which is formed connection sections connecting to a connector, respectively, in which the connection section of the connection terminal of said first type of connection terminal is bent vertically; and wherein an end portion is bent on one side of said connecting terminal part and is inserted into a rectangular hole located on the connection terminal.

2. The connecting terminal for a storage battery according to claim 1, wherein said tightening bolt has a screw thread only at its lower end portion.

3. The connecting terminal for a storage battery according to claim 1, further comprising:

a rubber arrangement having a piercing hole located at a portion corresponding to an insertion hole at the lower end on another side of said connecting terminal part;

protrusions in a shape of a ring respectively formed around a rim of a bottom side of said piercing hole; and a band-shaped rubber cap, having a cap connecting to said insertion hole at the upper end on the other side of said connecting terminal part and covering from the lower end of one side of the connecting terminal part to said insertion hole of the upper end on the other side.

4. The connecting terminal for a storage battery according to claim 3, wherein said tightening bolt has a screw thread only at its lower end portion.

5. A connecting terminal for a storage battery, which comprises a connecting terminal part which tightens insertion holes, to which a post-terminal is inserted, by a tightening bolt; and selectively attachable connection terminals connected thereto, which connects a wire connector;

wherein said connection terminals comprises three or more units of connection terminals in which one side of one of the connection terminals, connected over the connecting terminal part and a connecting member, is selectively attachable with one another, and which one side of the remaining connection terminals, respectively, connected to the connecting member, are selectively attachable with one another;

wherein connection sections which connect the connector are respectively formed on the other side of said connection terminals;

wherein said connection sections of at least two of said connection terminals are bent vertically;

wherein an end portion of one side of said connecting terminal part is bent upward and is inserted into a rectangular hole located on the connecting member; and wherein end portions of two lateral sides of said connecting member are bent upward and are inserted into rectangle of holes located on two sides of the connection terminals.

6. The connecting terminal for a storage battery according to claim 5, wherein said tightening bolt has a screw thread only at its lower end portion.

7. The connecting terminal for a storage battery according to claim 5, further comprising:

a rubber arrangement having a piercing hole located at a portion corresponding to an insertion hole at the lower end on another side of said connecting terminal part;

protrusions in a shape of a ring respectively formed around a rim of a bottom side of said piercing hole; and a band-shaped rubber cap, having a cap connecting to said in insertion hole at the upper end on the other side of said connecting terminal part and covering from the lower end of one side of the connecting terminal part to said in insertion hole of the upper end on the other side.

8. The connecting terminal for a storage battery according to claim 7, wherein said tightening bolt has a screw thread only at its lower end portion.

9. A connecting terminal arranged to connect to a post-terminal of a storage battery, the connecting terminal comprising a connecting terminal part including a tightening bolt to tighten insertion holes, said insertion holes arranged to receive the post-terminal of the storage battery; and further comprising selectively attachable connection terminals connected thereto, said selectively attachable connection terminals arranged to receive a wire connector;

wherein said connection terminals comprise first and second types of connection terminals, which are overlapping thereto, one side of which is connected to the connecting terminal part, respectively, and to another side of which is formed connection sections connecting to a connector, respectively, in which the connection section of the connection terminal of said first type of connection terminal is bent vertically; and wherein an end portion is bent on one side of said connecting terminal part and is arranged to be inserted into a rectangular hole located on the connection terminal.

10. The connecting terminal according to claim 9, wherein said tightening bolt has a screw thread only at its lower end portion.

11. The connecting terminal according to claim 9, further comprising:

a rubber arrangement having a piercing hole located at a portion corresponding to an insertion hole at the lower end on another side of said connecting terminal part; protrusions in a shape of a ring respectively formed around a rim of a bottom side of said piercing hole; and a band-shaped rubber cap, having a cap connecting to said insertion hole at the upper end on the other side of said connecting terminal part and covering from the lower end of one side of the connecting terminal part to said insertion hole of the upper end on the other side.

12. The connecting terminal according to claim 11, wherein said tightening bolt has a screw thread only at its lower end portion.

13. A connecting terminal arranged to connect to a post-terminal of a storage battery, said connecting terminal comprising a connecting terminal part including a tightening bolt to tighten insertion holes, said insertion holes arranged to receive the post-terminal of the storage battery; and further comprising selectively attachable connection terminals connected thereto, said selectively attachable connection terminals arranged to receive a wire connector;

wherein said connection terminals comprises three or more units of connection terminals in which one side of one of the connection terminals, connected over the connecting terminal part and a connecting member, is selectively attachable with one another, and which one side of the remaining connection terminals, respectively, connected to the connecting member, are selectively attachable with one another;

wherein connection sections which connect the connector are respectively formed on the other side of said connection terminals;

wherein said connection sections of at least two of said connection terminals are bent vertically;

wherein an end portion of one side of said connecting terminal part is bent upward and is arranged to be inserted into a rectangular hole located on the connecting member; and wherein end portions of two lateral sides of said connecting member are bent upward and are arranged to be inserted into rectangle of holes located on two sides of the connection terminals.

14. The connecting terminal according to claim 13, wherein said tightening bolt has a screw thread only at its lower end portion.

15. The connecting terminal according to claim 13, further comprising:

a rubber arrangement having a piercing hole located at a portion corresponding to an insertion hole at the lower end on another side of said connecting terminal part;

protrusions in a shape of a ring respectively formed around a rim of a bottom side of said piercing hole; and a band-shaped rubber cap, having a cap connecting to said in insertion hole at the upper end on the other side of said connecting terminal part and covering from the lower end of one side of the connecting terminal part to said in insertion hole of the upper end on the other side.

16. The connecting terminal according to claim 15, wherein said tightening bolt has a screw thread only at its lower end portion.

* * * * *